US010406530B2

(12) United States Patent
Fant et al.

(10) Patent No.: US 10,406,530 B2
(45) Date of Patent: Sep. 10, 2019

(54) MATERIAL PROCESSING MACHINES AND METHODS OF USE

(71) Applicant: Urschel Laboratories, Inc., Chesterton, IN (US)

(72) Inventors: James A. Fant, Chesterton, IN (US); Michael Scot Jacko, Valparaiso, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 527 days.

(21) Appl. No.: 15/216,003

(22) Filed: Jul. 21, 2016

(65) Prior Publication Data

US 2017/0021360 A1 Jan. 26, 2017

Related U.S. Application Data

(60) Provisional application No. 62/195,940, filed on Jul. 23, 2015.

(51) Int. Cl.

| | |
|---|---|
| ***B02C 18/06*** | (2006.01) |
| ***B02C 18/12*** | (2006.01) |
| ***B02C 18/16*** | (2006.01) |
| ***B02C 18/08*** | (2006.01) |
| ***B02C 23/18*** | (2006.01) |

(52) U.S. Cl.

CPC ..... *B02C 18/062* (2013.01); *B02C 18/08* (2013.01); *B02C 18/12* (2013.01); *B02C 18/16* (2013.01); *B02C 23/18* (2013.01)

(58) Field of Classification Search

CPC ..... B02C 18/062; B02C 18/08; B02C 18/12; B02C 23/18; B02C 18/16

USPC ..... 241/21, 86.1, 89.3, 242, 260

See application file for complete search history.

(56) References Cited

U.S. PATENT DOCUMENTS

| | | | |
|---|---|---|---|
| 4,422,581 | A | 12/1983 | Chryst |
| 4,529,794 | A | 7/1985 | Sortwell et al. |
| 4,603,156 | A | 7/1986 | Sortwell |
| 4,610,397 | A | 9/1986 | Fischer et al. |
| 4,640,622 | A | 2/1987 | Sortwell |
| 4,657,190 | A | 4/1987 | Fischer et al. |
| 4,660,778 | A | 4/1987 | Fischer et al. |
| 4,778,280 | A | 10/1988 | Brazelton |
| 4,874,588 | A | 10/1989 | Sortwell et al. |
| 5,201,469 | A | 4/1993 | Urschel |

(Continued)

OTHER PUBLICATIONS

International Search Report and Written Opinion dated Nov. 3, 2016 on PCT/US16/43456.

*Primary Examiner* — Christopher M Koehler

*Assistant Examiner* — Mohammed S. Alawadi

(74) *Attorney, Agent, or Firm* — Hartman Global IP Law; Gary M. Hartman; Domenica N. S. Hartman

(57) ABSTRACT

Machines and methods adapted to process, for example, to reduce the size of, disperse, or homogenize, a variety of materials and compositions. Such methods and machines are capable of reducing the size of a material and dispersing the material in a liquid by cutting the material with knives located along a perimeter of an annular-shaped cutting head, causing the cut material to flow radially outward from the cutting head through gaps between the knives, and flowing a liquid through passages in the cutting head that cause the liquid to cascade around the knives of the cutting head in an axial direction of the cutting head.

18 Claims, 7 Drawing Sheets

(56) References Cited

U.S. PATENT DOCUMENTS

| | | | | |
|---|---|---|---|---|
| 6,257,511 | B1 | 7/2001 | Turner | |
| 7,048,432 | B2 | 5/2006 | Phillippi et al. | |
| 7,794,135 | B2 | 9/2010 | El Kholy et al. | |
| 8,186,871 | B2 | 5/2012 | Pich et al. | |
| 8,322,922 | B2 | 12/2012 | Pich et al. | |
| 2002/0063178 | A1* | 5/2002 | Strutz | B02C 18/24 241/21 |
| 2007/0181719 | A1* | 8/2007 | Berger | E03C 1/2665 241/46.013 |
| 2007/0221765 | A1* | 9/2007 | Hanson | B02C 18/0092 241/46.013 |
| 2014/0091162 | A1 | 4/2014 | Jacko et al. | |
| 2015/0069154 | A1 | 3/2015 | Voltolini | |

* cited by examiner

MATERIAL PROCESSING MACHINES AND METHODS OF USE

CROSS REFERENCE TO RELATED APPLICATIONS

This application claims the benefit of U.S. Provisional Application No. 62/195,940, filed Jul. 23, 2015, the contents of which are incorporated herein by reference.

BACKGROUND OF THE INVENTION

The present invention generally relates to methods, machines, and equipment for processing materials, for example, to reduce the size of, disperse, or homogenize a material.

Various types of equipment are known for processing materials, for example, slicing, dicing, shredding, granulating, comminuting, or otherwise reducing the size of solid materials. A widely used line of comminuting machines is commercially available from Urschel Laboratories, Inc., under the name Comitrol®, aspects of which are disclosed in patent documents including U.S. Pat. Nos. 4,660,778, 4,610,397, 4,657,190, and 5,201,469, whose contents are incorporated herein by reference. Comitrol® machines are capable of uniformly comminuting, dispersing, or homogenizing a wide variety of materials and compositions at high production capacities, for example, food products including fruits, vegetables, dairy products, and meat products, as well as nonfood products including polymeric materials, chemicals, and pharmaceuticals in a variety of forms (e.g., liquids, sols, gels, slurries, pastes, solids, etc.).

A known configuration for a Comitrol® machine is depicted in exploded views in FIGS. 1 and 2. The machine, the particular model of which is the Model 1700, is represented as comprising a cutting assembly 10 and feed hopper 12 through which material is fed to the cutting assembly 10 via a feed tube 13. FIGS. 1 and 2 depict the cutting assembly 10 as comprising an impeller 24 rotatably mounted within an annular-shaped cutting head 26. An electric motor 14 and drive belt 16 rotate a spindle 22 on which the impeller 24 is mounted for rotating the impeller 24 within the cutting head 26. Material delivered through the feed hopper 12 to the rotating impeller 24 is forced by paddles or blades 25 of the impeller 24 into engagement with uniformly spaced knives 40 mounted at the inner perimeter of the cutting head 26 and oriented parallel to the impeller axis. The spacings between the knives 40 affect the size of the resulting size-reduced product. An upper enclosure 18 surrounds the cutting assembly 10, from which size-reduced material exits and falls before being discharged from the machine through a lower enclosure 20. The particular cutting assembly 10 depicted in FIG. 1 is referred to as a "Microcut," which is especially well suited for performing dispersion and homogenization processes to produce a variety of liquids, sols, gels, slurries, pastes, etc. As evident from FIG. 1, the depicted configuration is adapted to be mounted with a table that supports the motor 12.

FIGS. 2, 3 and 4 depict certain components of the machine of FIG. 1 in more detail. FIG. 2 depicts the impeller 24 separated from the cutting head 26 and a unit comprising a retaining ring, wear ring and face seal 28 through which the cutting head 26 is mounted within the machine. FIG. 3 is an exploded view showing certain components of the cutting head 26, namely, a backing ring assembly 34 that secures a pair of upper and lower knife holding rings 30 and 32 between and to, respectively, a pair of upper and lower support rings 36 and 38 that are spaced apart by posts 39. The backing ring assembly 34 comprises a pair of upper and lower retainer rings 35A and 35B spaced apart by posts 37, and the retainer rings 35A and 35B secure, respectively, the upper and lower knife holding rings 30 and 32 within recesses formed in the upper and lower support rings 36 and 38. FIG. 4 is a partial fragmentary view of the cutting head 26 showing the manner in which the knives 40 can be mounted and secured between the knife holding rings 30 and 32 to have a generally radial and axial orientation relative to the head 26 (and, therefore, to the impeller 24). Centrifugal force causes material delivered to the high speed rotating impeller 24 to move radially outward into engagement with the knives 40, where the material strikes exposed cutting edges of the knives 40. This action results in the removal of small particles from the material until reduction is completed. Particles are discharged through the gaps between the knives 40 before exiting the machine through the upper and lower enclosures 18 and 20.

Various other configurations of Comitrol® machines, including their drive systems, knife assemblies and impellers, are also available beyond that represented in FIG. 1. As a nonlimiting example, the cutting assembly 10 may comprise an impeller and cutting head that have smaller or larger axial and/or radial dimensions than what is shown in FIGS. 1 through 4, for example, including the configurations disclosed in U.S. Pat. Nos. 4,660,778, 4,610,397, 4,657,190.

Material reduction machines of the type described above and represented in FIGS. 1 through 4 have performed extremely well for use with a wide variety of materials and applications. For some applications, when dispersing a solid material in a liquid, the solid material and liquid may be delivered to the cutting assembly 10 together via the hopper 12, for example, combined to form a mixture prior to entering the hopper 12, or combined within the hopper 12 to form a mixture. In such cases, it may be desirable or necessary to control the relative amounts of solid material and liquid delivered to the cutting assembly 10, for example, to obtain a mixture having a desired consistency, viscosity, etc., for processing by the assembly 10. In addition or alternatively, it may be desirable or necessary to separately deliver additional liquid to the assembly 10 apart from the solid material or mixture. One such example is the dispersion and dissolving of solid materials in a liquid to produce a sol, gel, slurry, paste, etc., a particular example of which is the production of polymer-water suspensions used to displace oil in enhanced oil recovery (EOR) and oil sands tailings treatment applications. To produce such suspensions, a mixture of water and solid particles of a water-soluble polymeric material can be introduced into a Comitrol® machine, where the polymer particles are comminuted and then dissolved in the water. In such applications, there are occasions where the final suspension exhibits more desirable properties for its intended use if it contains more water than what may be needed or optimal for cutting and dissolving the polymer particles. Alternatively or in addition, it can be advantageous to rinse the knives of the cutting head during operation to avoid a build-up of comminuted polymer particles between the knives. In either case, Comitrol® machines have been modified with nozzles fed by external water lines or manifolds to direct high pressure water at the outer perimeter of their cutting heads.

BRIEF DESCRIPTION OF THE INVENTION

The present invention provides machines and methods adapted to process, for example, to reduce the size of, disperse, or homogenize, a variety of materials and compositions, a nonlimiting example of which is the dispersion and dissolving of polymeric materials in a liquid to produce a suspension, sol, gel, slurry, paste, etc.

According to one aspect of the invention, a material processing machine includes an enclosure comprising a fluid inlet and a channel fluidically connected to the fluid inlet, and a cutting assembly within the enclosure. The cutting assembly includes a cutting head and an impeller adapted for rotation within the cutting head about an axis thereof. The cutting head has a support member and knives disposed below the support member, and the support member includes at least a first passage fluidically connected to the channel of the enclosure to receive therefrom a liquid flowing in the channel and to conduct the liquid through the support member.

Additional aspects of the invention include kits that include an enclosure and cutting head of the type described above to modify or retrofit an existing machine, as well as methods of using a machine to process a solid material by reducing the size of the material and dispersing the material in a liquid. Such methods include cutting the material with knives located along a perimeter of an annular-shaped cutting head and causing the cut material to flow radially outward from the cutting head through gaps between the knives, and flowing a liquid through passages in the cutting head that cause the liquid to cascade around the knives of the cutting head in an axial direction of the cutting head.

A technical effect of the invention is that, when dispersing, dissolving, or otherwise mixing a solid material in a liquid, additional liquid can be delivered to the cutting head in an efficient and effective matter, and without the need for nozzles, external waterlines, manifolds, and a source of high pressure water. The additional liquid delivered to the cutting head can be utilized for various purposes, for example, to modify the nature of the resulting product, for example, by increasing its fluidity and/or inhibiting the build-up of particles between knives.

Other aspects and advantages of this invention will be better appreciated from the following detailed description.

DETAILED DESCRIPTION OF THE INVENTION

FIGS. 5 through 9 schematically represent various nonlimiting views of a material processing machine and components thereof within the scope of the invention. The machine described below can be any of various types of machines, as nonlimiting examples, the Comitrol® machine depicted in FIGS. 1 through 4 or one or more of the machines disclosed in U.S. Pat. Nos. 4,660,778, 4,610,397, 4,657,190, and 5,201,469, and can utilize certain components thereof, for example, the components of the Comitrol® machine depicted in FIGS. 1 through 4. FIGS. 5 through 9 illustrate a particular nonlimiting embodiment of the invention that includes components that can be modifications of or in addition to components of the machine represented in FIGS. 1 through 4. Therefore, the following discussion will focus primarily on certain aspects of the embodiment represented in FIGS. 5 through 9, whereas other aspects not discussed in any detail may be, in terms of structure, function, materials, etc., essentially as was described for the machine and components of FIGS. 1 through 4. In FIGS. 5 through 9, consistent reference numbers are used to identify components that are the same or functional equivalents of components identified in FIGS. 1 through 4, but with a numerical prefix (1) added to distinguish components depicted in FIGS. 5 through 9 from their counterparts depicted in FIGS. 1 through 4.

Figure 1:
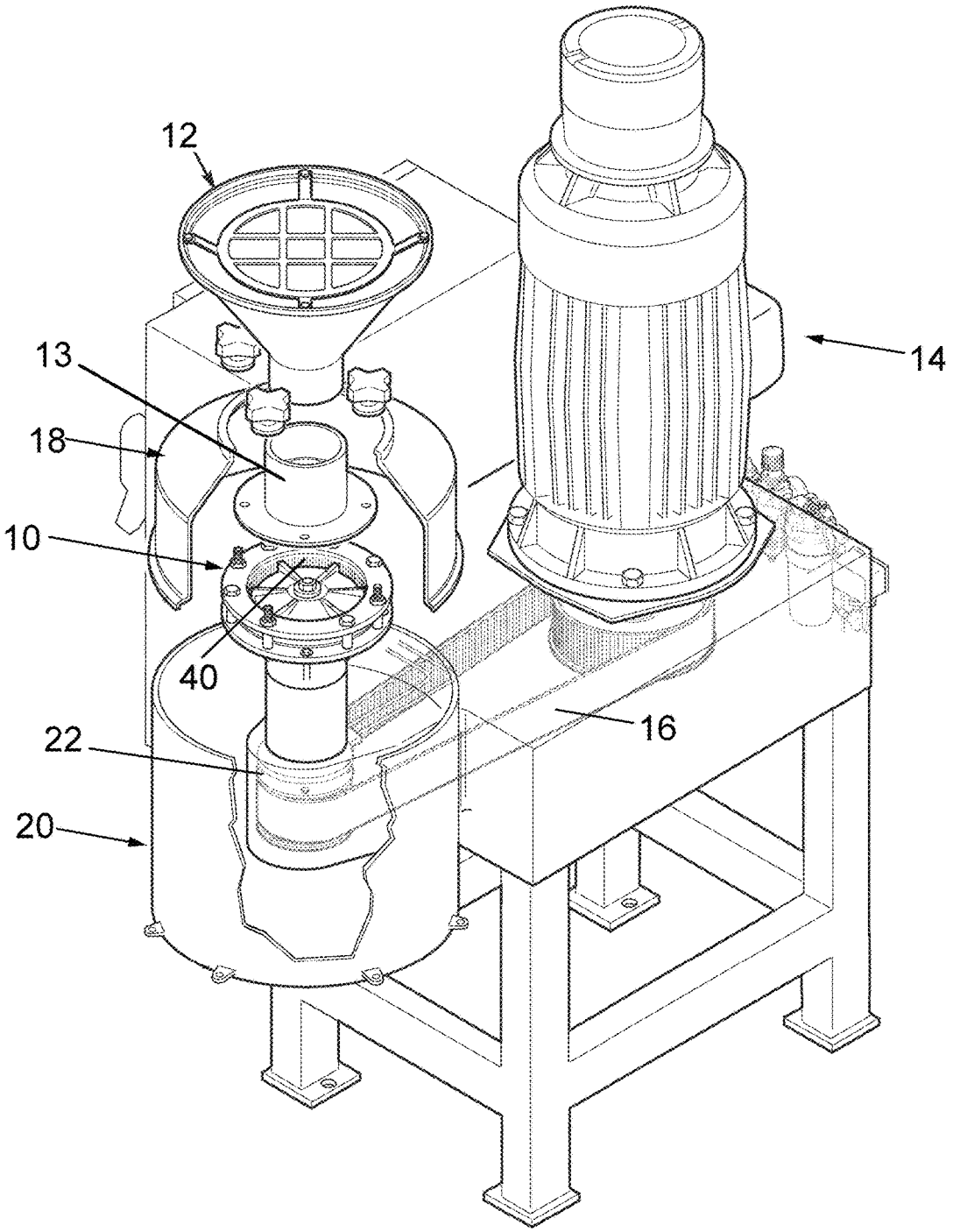
FIG. 1 (Prior Art)
FIGS. 1 and 2 represent a commercial configuration of a COMITROL® machine known in the prior art.
Figure 2:
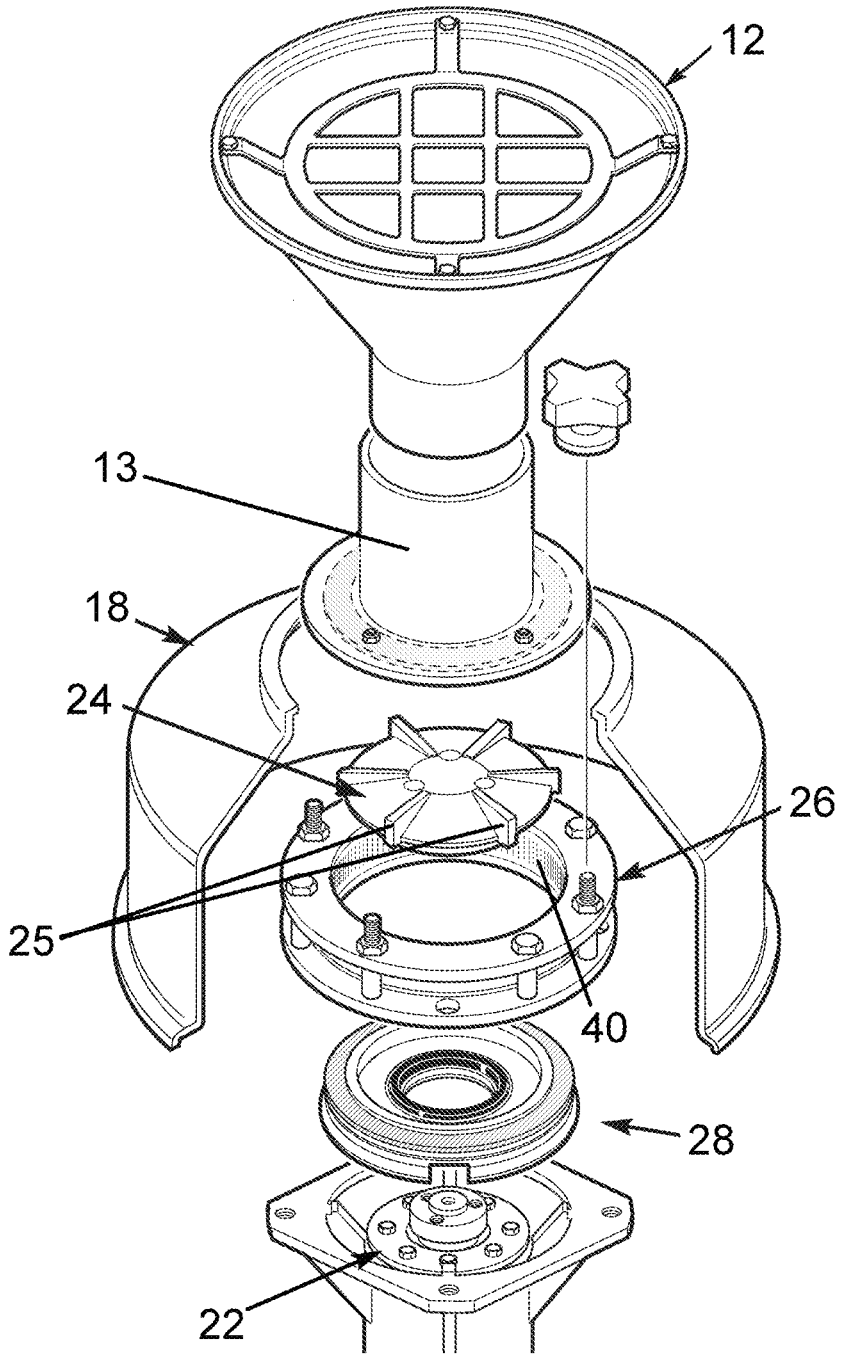
FIG. 2 (Prior Art)
Figure 3:
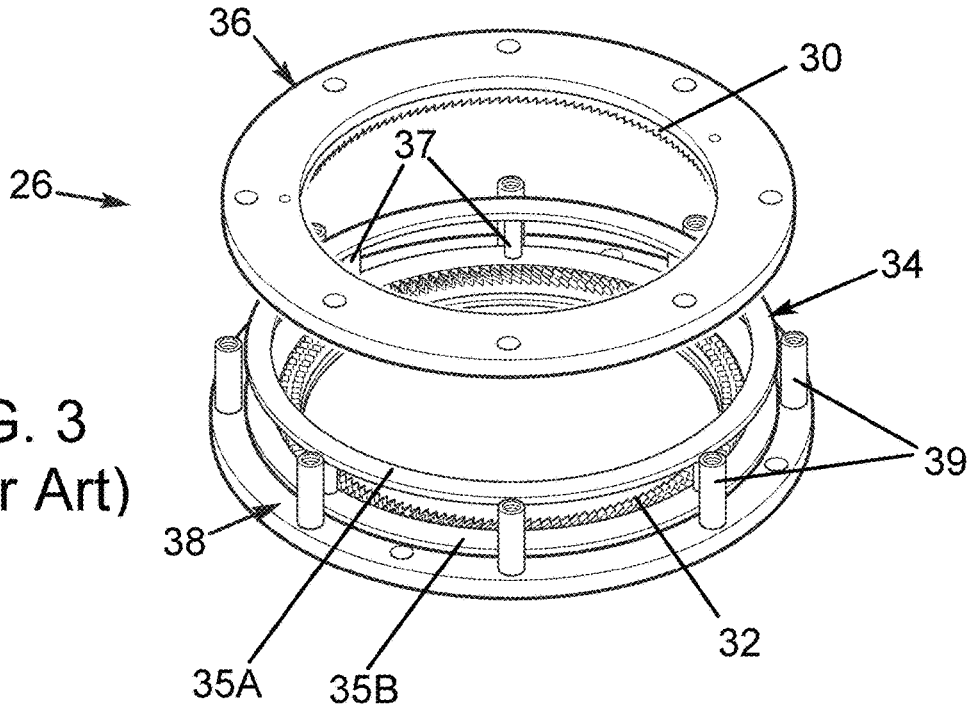
FIG. 3 (Prior Art)
FIGS. 3 and 4 illustrate nonlimiting configurations for a cutting head suitable for use with the machine of FIGS. 1 and 2.
Figure 4:
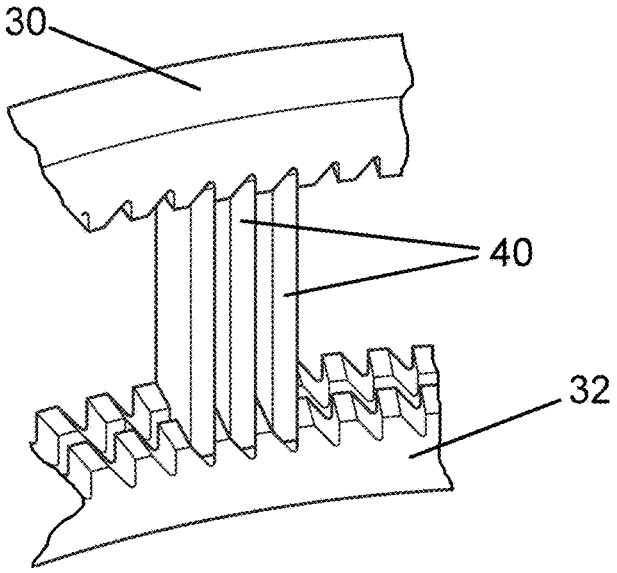
FIG. 4 (Prior Art)

To facilitate the description of embodiments of the invention provided below, relative terms, including but not limited to, "vertical," "horizontal," "upper," "lower," "above," "below," etc., may be used in reference to the orientation of the machine as represented in FIGS. 1 and 2, and therefore are relative terms that help to describe the embodiments but should not necessarily be interpreted as limiting the scope of the invention.

Figure 5:
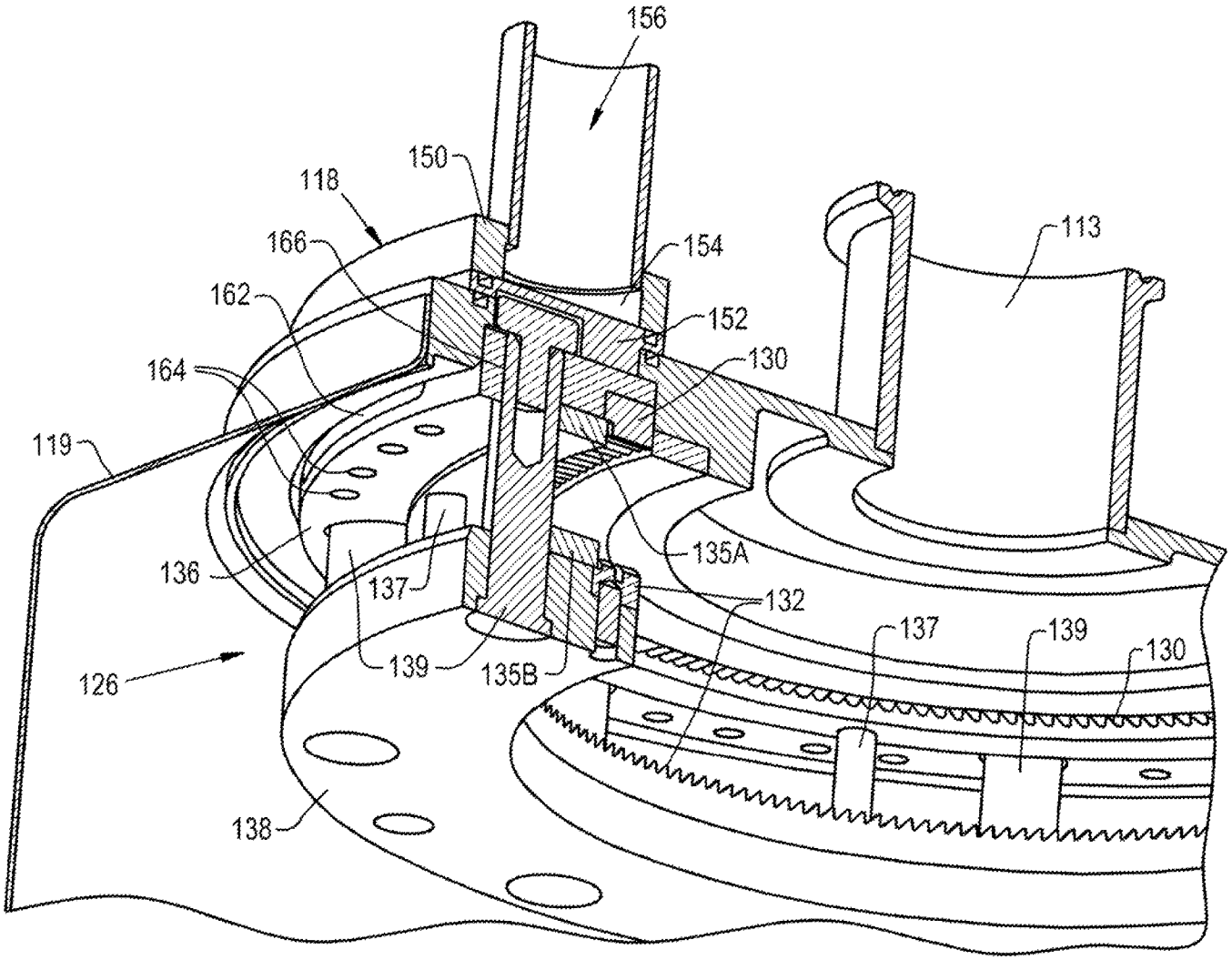
FIGS. 5 and 6 schematically represent two partial sectional views of an enclosure and cutting head suitable for installation and use with the machine of FIGS. 1 and 2.
Figure 6:
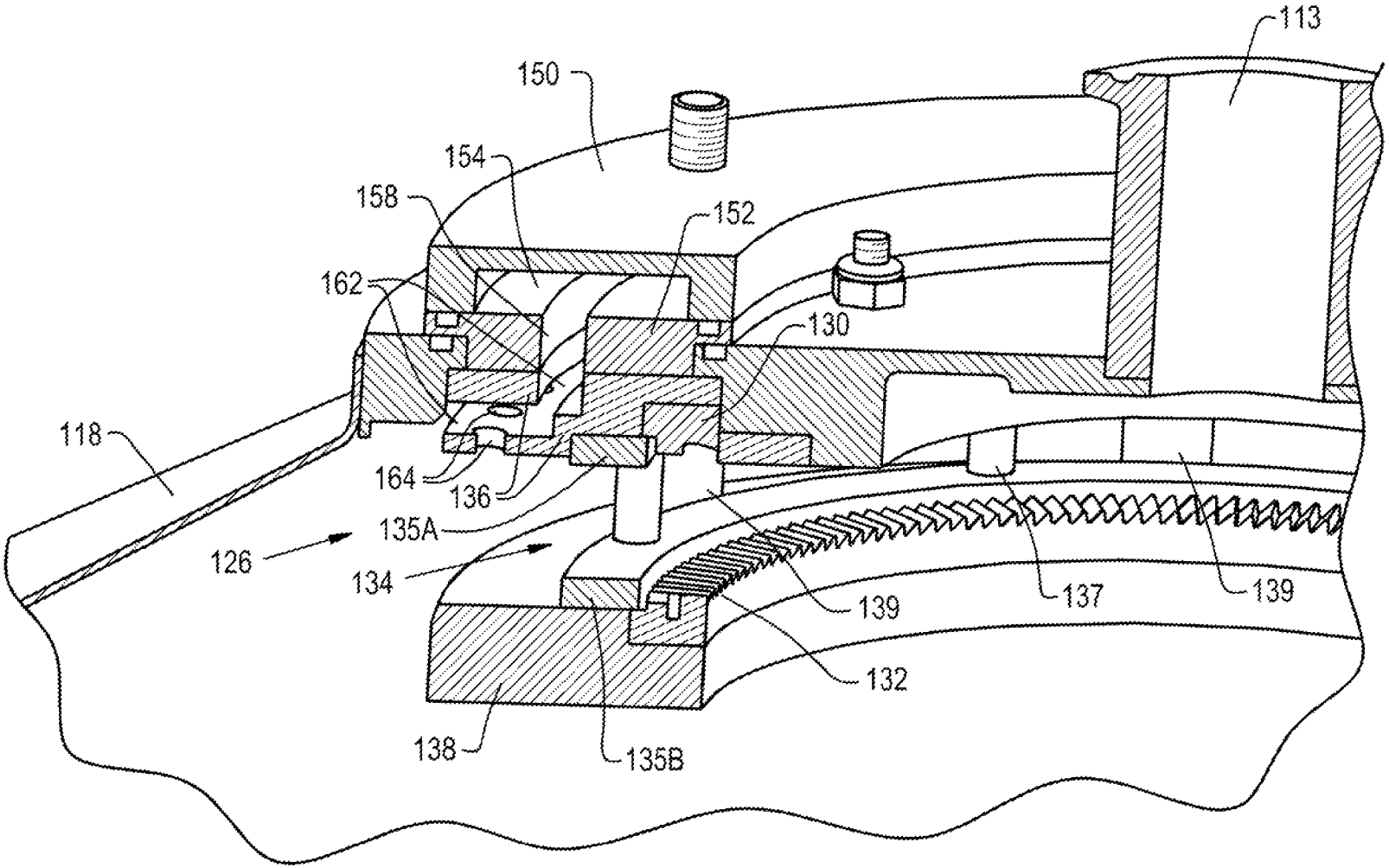
Figure 7:
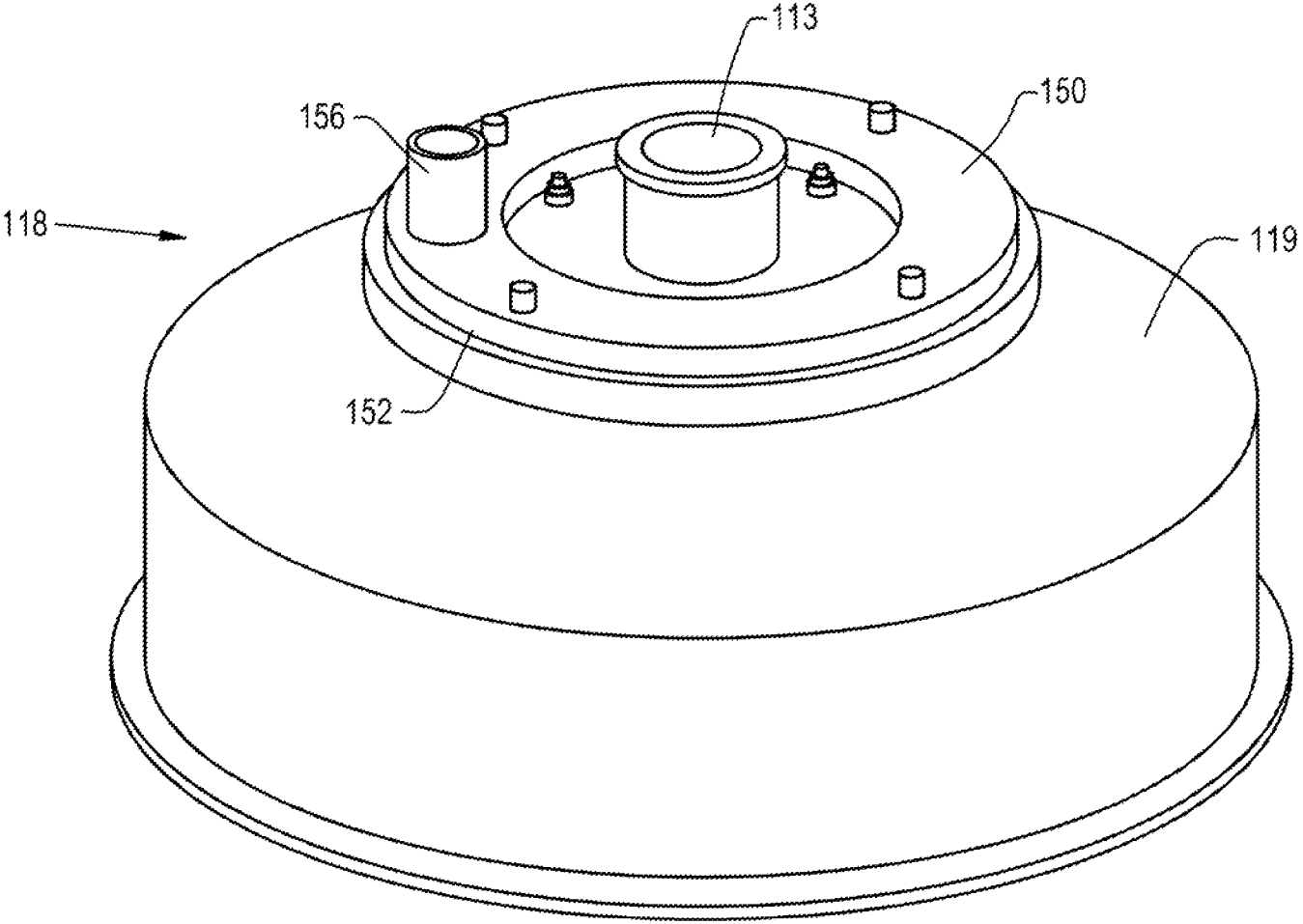
FIG. 7 schematically represents an isolated view of the enclosure depicted in FIGS. 5 and 6.

FIGS. 5 and 6 are partial cross-sectional views in which can be seen an enclosure 118 and cutting head 126. The cutting head 126 is an annular-shaped subcomponent of a cutting assembly that further includes an impeller, which is not depicted in FIGS. 5 and 6 for purposes of clarity but would be assembled with the cutting head 126 as shown and described in reference to FIGS. 1 and 2. Consistent with FIG. 3, the cutting head 126 comprises a backing ring assembly 134 that secures a pair of upper and lower knife holding rings 130 and 132 to, respectively, a pair of upper and lower members configured in the form of rings 136 and 138 that are axially spaced apart by circumferentially-spaced posts 139. Consistent with FIG. 4, the knife holding rings 130 and 132 are adapted to mount and secure knives (not shown) therebetween, position the knives along the inner perimeter of the cutting head 126, and generally provide the knives 40 with a radial and axial orientation relative to the cutting head 126. The backing ring assembly 134 comprises a pair of upper and lower retainer rings 135A and 135B that are axially spaced apart by circumferentially-spaced posts 137, and the retainer rings 135A and 135B secure, respectively, the upper and lower knife holding rings 130 and 132 within recesses formed in the upper and lower support rings 136 and 138. Similar to the support rings 36 and 38 of the cutting head 26 shown in FIGS. 1 through 3, the upper and lower rings 136 and 138 serve to support other components of the cutting head 126, and as such the rings 136 and 138 will be hereinafter referred to as support rings. Though described as "rings," it is foreseeable that the support rings 136 and 138 could have other shapes consistent with their role within a cutting head that surrounds a rotating impeller.

Figure 8:
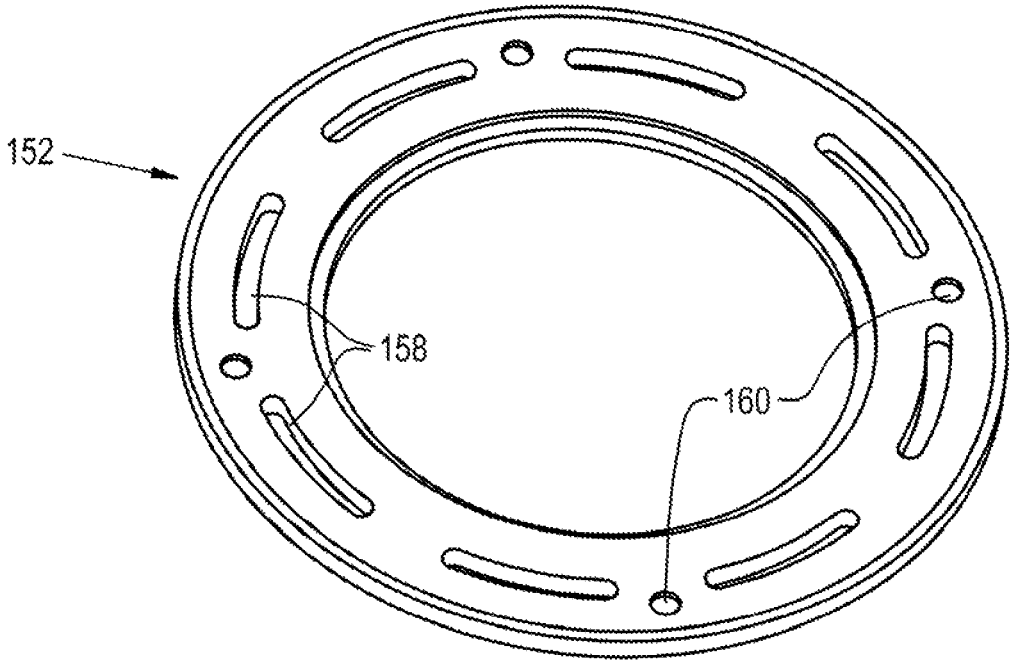
FIG. 8 schematically represents an isolated view of a distribution ring depicted in FIGS. 5 and 6.

In view of the above, it should be understood that a machine equipped with the cutting head 126 is adapted to process material delivered to an impeller coaxially mounted for rotation within the cutting head 126, and that such material can be delivered via a feed tube 113 coupled to the enclosure 118 and supplied by a feed hopper (not shown), though other feeding means are also foreseeable and within the scope of the invention, for example, feed screws. FIGS. 5 and 6 represent the enclosure 118 as an assembly that comprises a housing 119, a channel ring 150, and a distribution ring 152. Together, the channel and distribution rings 150 and 152 define a channel 154 therebetween that is preferably annular in shape, continuous, and circumscribes the feed tube 113 at an upper end of the enclosure 118, as evident from FIG. 7. O-ring grooves are provided for receiving seals (not shown) capable of achieving fluid-tight seals between the enclosure 118, channel ring 150, and distribution ring 152. A liquid, for example, water, can be delivered to the channel 154 via an inlet 156 coupled to the channel ring 150 (FIG. 5). As seen in FIG. 8, the distribution ring 152 has at least one and preferably multiple passages in the form of slots 158 that pass entirely through the axial thickness of the ring 152, so that a liquid that enters the channel 154 through the inlet 156 is able to pass through the distribution ring 152 at multiple locations around the perimeter of the cutting head 126.

Figure 9:
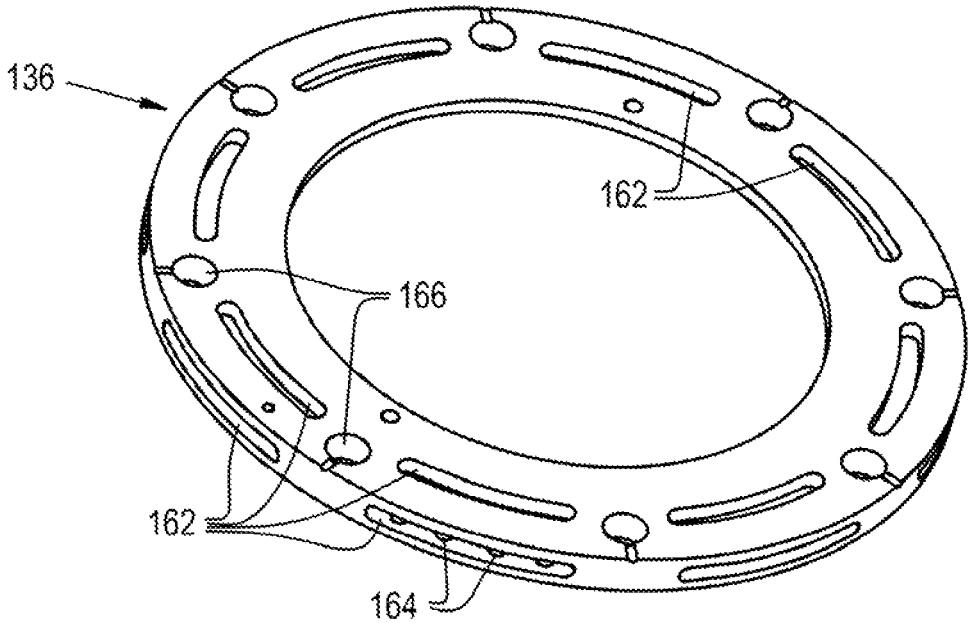
FIG. 9 schematically represents an isolated view of an upper support ring depicted in FIGS. 5 and 6.

FIGS. 5 and 9 represent the upper support ring 136 of the cutting head 126 as having holes 166 that pass entirely through its axial thickness for receiving upper ends of the posts 139 that connect the upper support ring 136 to the lower support ring 138, as evident in FIG. 5. The distribution ring 152 can be seen in FIG. 8 as having holes 160 that pass entirely through its axial thickness to provide access to the upper ends of the posts 139. FIGS. 5, 6 and 9 further represent the upper support ring 136 as differing in part from the upper support ring 36 depicted in FIG. 3 by having passages in the form of slots 162 and holes 164. The slots 162 are configured to intersect an upper axial surface of the support ring 136 and an outer peripheral surface of the ring 136, such that each slot 162 has two portions that intersect each other within the ring 136, for example, at roughly ninety degrees. FIGS. 5 and 6 depict that there are multiple holes 164 that intersect each slot 162 from the lower axial surface of the ring 136.

FIGS. 5 and 6 represent the channel ring 150 and distribution ring 152 of the enclosure 118 and the upper support ring 136 of the cutting head 126 as axially aligned through an annular-shaped opening in the enclosure 118, such that the distribution ring 152 and upper support ring 136 axially abut each other. As evident from FIG. 6, the slots 162 and holes 164 of the support ring 136 can be aligned with the slots 158 of the distribution ring 152. In combination, the slots 158 and 162 and holes 164 enable a liquid within the channel 154 of the channel ring 150 to flow through the distribution ring 152 and then through the support ring 136, from which the liquid flows onto and around other components of the cutting head 126, including the knives thereof.

On the basis of the above, a material processing machine equipped with the enclosure 118 and cutting head 126 can be employed to reduce the size of a solid material by introducing the material to a impeller (e.g., the impeller 24 of FIGS. 1 and 2) rotating within the cutting head 126 to comminute the material with knives (e.g., the knives 40 of FIGS. 1, 2 and 4) of the cutting head 126 and cause the comminuted material to flow radially outward through gaps between the knives. Furthermore, such a material processing machine is also configured to introduce a liquid into the channel 154 within the enclosure 118 via the fluid inlet 156 so that the liquid flows through the distribution and support rings 152 and 136. The flow of the liquid can generally be characterized as a waterfall or cascade in a downward direction generally parallel to the axis of the cutting head 126 and to the axis of rotation of the impeller 124 within the cutting head 126. In this manner, the liquid introduced into the enclosure 118 can deliver any additional liquid required by the comminution process performed within the enclosure 118, as well as serve to remove any accumulation of material on or between the knives of the cutting head 126. It should be understood that a material processing machine equipped with the enclosure 118 and cutting head 126 described above can be a new build, or the enclosure 118 and cutting head 126 could be provided in the form of a kit used to modify or retrofit an existing machine.

The amount of liquid supplied can depend on the requirements of the particular process, including composition of the material being processed and the nature of the resulting product, for example, a suspension, sol, gel, slurry, paste, etc. An application in which the enclosure 118 and cutting head 126 configured as described above are believed to provide particular benefits is the production of a polymer-water suspension used to displace oil in enhanced oil recovery (EOR) and oil sands tailings treatment applications, in which case the machine serves to cut and preferably comminute polymer particles and simultaneously mix, disperse, and/or dissolve the comminuted particles in water. Such processes are disclosed in U.S. Pat. Nos. 4,529,794, 4,603,156, 4,640,622, 4,778,280, 4,874,588, 7,048,432, 7,794,135, 8,186,871, and 8,322,922, whose contents are incorporated herein by reference. Other applications are also foreseeable, particularly where a liquid is to be added to a material after particles of the material have been reduced in size.

While the invention has been described in terms of specific embodiments, it is apparent that other forms could be adopted by one skilled in the art. For example, the physical configurations of the components and machine could differ from those shown. As nonlimiting examples, the invention is applicable to other Comitrol® machines, such as the Comitrol® Model 1700 or 9300, as well as other material processing and size-reduction machines. Accordingly, it should be understood that the invention is not limited to any embodiment described herein or illustrated in the drawings. It should also be understood that the phraseology and terminology employed above are for the purpose of describing the illustrated embodiments, and do not necessarily serve as limitations to the scope of the invention. Therefore, the scope of the invention is to be limited only by the following claims.

The invention claimed is:

1. A material processing machine comprising:

an enclosure comprising a fluid inlet and a channel fluidically connected to the fluid inlet; and a cutting assembly within the enclosure, the cutting assembly comprising a cutting head surrounding an impeller adapted for rotation within the cutting head about an axis thereof, the cutting head comprising a support ring that surrounds the impeller and knives disposed below the support ring, the support ring comprising multiple first passages that are fluidically connected to the channel of the enclosure to receive therefrom a liquid flowing in the channel and configured to conduct the liquid along a perimeter of the cutting head, through the support ring, and onto portions of the cutting head that are below the support ring and surround the impeller.

2. The material processing machine according to claim 1, wherein the enclosure comprises a distribution ring having at least one passage therein that fluidically connects the channel of the enclosure and the first passage in the support ring of the cutting head.

3. The material processing machine according to claim 2, wherein the distribution ring and the support ring are annular shaped and axially abut each other.

4. The material processing machine according to claim 1, wherein the first passage in the support ring of the cutting head intersects a first axial surface of the support ring and intersects a peripheral surface of the support ring.

5. The material processing machine according to claim 4, wherein the first passage of the support ring is configured such that the liquid flowing therethrough cascades around the knives of the cutting head in an axial direction of the cutting head.

6. The material processing machine according to claim 4, further comprising at least a second passage in the support ring of the cutting head that is fluidically connected to the first passage and intersects a second axial surface of the support ring oppositely disposed from the first axial surface thereof, and the second passage is configured such that the liquid flowing therethrough cascades around the knives of the cutting head in an axial direction of the cutting head.

7. The material processing machine according to claim 6, wherein the second passage of the support ring is configured such that the liquid flowing therethrough cascades around the knives of the cutting head in an axial direction of the cutting head.

8. The material processing machine according to claim 4, wherein the support ring further comprises a plurality of second passages that are spaced around a perimeter of the cutting head, fluidically connected to the first passages, and intersect a second axial surface of the support ring oppositely disposed from the first axial surface thereof, and the second passages are configured such that the liquid flowing therethrough cascades around the knives of the cutting head in an axial direction of the cutting head.

9. The material processing machine according to claim 1, wherein the knives are comminution knives that have a radial and axial orientation relative to the cutting head.

10. A method of reducing the size of a solid material using the material processing machine of claim 1, the method comprising:

introducing the material to the impeller while rotating the impeller to comminute the material with the knives of the cutting head and cause the comminuted material to flow radially outward through gaps between the knives; and introducing a liquid into the channel via the fluid inlet of the enclosure, the liquid flowing through the first passage of the support ring and cascading around the knives of the cutting head in an axial direction of the cutting head.

11. The method according to claim 10, wherein the method produces a suspension, sol, gel, slurry, or paste.

12. The method according to claim 10, wherein the method produces a polymer-water suspension and the method further comprises using the polymer-water suspension to displace oil in enhanced oil recovery (EOR) and oil sands tailings treatment applications.

13. The method according to claim 12, wherein the material is polymer particles, the liquid is water, and the material processing machine simultaneously mixes, disperses, and dissolves the comminuted polymer particles in the water.

14. A method of processing a solid material by reducing the size of the material and dispersing the material in a liquid, the method comprising:

cutting the material with knives located along a perimeter of an annular-shaped cutting head and causing the cut material to flow radially outward from the annular-shaped cutting head through gaps between the knives; and flowing a liquid through multiple first passages in the annular-shaped cutting head to conduct the liquid along the perimeter of the annular-shaped cutting head, through the annular-shaped cutting head, and onto the knives of the annular-shaped cutting head in an axial direction of the annular-shaped cutting head.

15. The method according to claim 14, wherein the annular-shaped cutting head is within an enclosure, the knives are located along the perimeter of the annular-shaped cutting head by a support ring thereof, the passages are located in the support ring, the cutting step comprises rotating an impeller within the annular-shaped cutting head, and the flowing step comprises delivering the liquid to the passages in the support ring through a channel of the enclosure.

16. The method according to claim 14, wherein the method produces a suspension, sol, gel, slurry, or paste.

17. The method according to claim 14, wherein the method produces a polymer-water suspension and the method further comprises using the polymer-water suspension to displace oil in enhanced oil recovery (EOR) and oil sands tailings treatment applications.

18. The method according to claim 17, wherein the material is polymer particles, the liquid is water, and the material processing machine dissolves the comminuted polymer particles in the water.

* * * * *